United States Patent [19]

Maloney et al.

[11] Patent Number: 4,930,772

[45] Date of Patent: Jun. 5, 1990

[54] BASEBALL BAT

[76] Inventors: Michael Maloney; Linda Watson, both of 4800 Oxborough La., Bloomington, Minn. 55347

[21] Appl. No.: 264,699

[22] Filed: Oct. 31, 1988

[51] Int. Cl.[5] ..... A63B 69/40

[52] U.S. Cl. ..... 273/26 B; 273/72 R; 273/72 A

[58] Field of Search ..... 273/72 A, 26 R, 26 B, 273/72 R, 67 R, 25; 124/5

[56] References Cited

U.S. PATENT DOCUMENTS

| | | | |
|---|---|---|---|
| 838,257 | 12/1906 | Kinst | 273/72 |
| 1,946,373 | 2/1934 | Walsh | 124/5 |
| 3,111,314 | 11/1963 | Topper | 273/72 R |
| 3,115,342 | 12/1963 | Webster | 273/26 |
| 3,120,387 | 2/1964 | Weinstein | 273/26 |
| 3,169,019 | 2/1965 | Genjack | 273/26 |
| 3,236,521 | 2/1966 | Knott | 273/26 |
| 4,006,900 | 2/1977 | DiVito | 273/26 B |

*Primary Examiner*—Edward M. Coven
*Assistant Examiner*—Mark J. Graham
*Attorney, Agent, or Firm*—William C. Flynn

[57] ABSTRACT

An improved ball bat for hitting and fielding practice comprising an elongate bat having at least one depressed ball holder disposed on said bat distal the handle thereof for temporarily holding a ball for hitting.

1 Claim, 1 Drawing Sheet

BASEBALL BAT

BACKGROUND OF THE INVENTION

The invention relates to a device for practicing and playing bat and ball games such as baseball or softball and more particularly as an improvement in bats allowing the user to more easily hit a ball.

Prior art shows several attempts to overcome the inherent shortcomings of the "toss and hit" method of hitting a ball. U.S. Pat. No. 3,115,342 issued Dec. 24, 1963 to Webster discloses a hollowed out bat wherein a plurality of balls may be placed within the bat and individually flipped into the air for hitting. The Webster device requires a specially constructed bat which while suitable for its intended use, would have a much different weight distribution than the "regulation" bat and would additionally require bats for using different sized balls.

U.S. Pat. No. 3,120,387 issued Feb. 4, 1964 to Weinstin discloses another hollow bat wherein the ball is ejected into the air for hitting using hydraulic pressure provided by a bellows-like attachment disposed upon the handle of the bat. A similar device is disclosed in U.S. Pat. No. 3,236,521 issued Feb. 22, 1966 to Knott, which again discloses a hollowed out bat wherein the ball is ejected from the end of the baseball bat using hydraulic or spring pressure for placement into the air in hitting. Both of these devices produce a hollowed out bat with additional attachments thereto having a weight distribution unlike the weight distribution of a regulation bat. Additionally, they require the ejection of the ball from the end of the bat through action of a lever or bellows device which will still require the user to place the ball in the air and change his hand grips while the ball remains in the air.

U.S. Pat. No. 3,169,019 issued Feb. 9, 1965 to Genjack discloses a baseball catching and throwing cup for attachment to a bat using a band extending around the bat. The device requires attachment to an existing bat which again upsets the balance of the bat while having an attachment strap surrounding the bat which is likely to interfere with the hitting of the ball.

SUMMARY OF THE INVENTION

Baseball, softball and the like are games involving hitting a ball with a bat. Before a person may play the game, the person must learn to hit and field the ball, a common problem in developing the hand-eye coordination necessary to hit the ball with some regularity. This skill requires a great deal of practice to master. The hitting skills can be taught, for example, by allowing the person to repeatedly attempt to hit a pitched ball. This method is limited by the requirement of having another person or a machine to pitch the balls and the person pitching the ball soon tires or the pitching machine used is quite expensive.

In another common learning method, a person while using a conventional bat held in one hand and a ball held in the other hand tosses the ball into the air in an area he can hit the ball and while the ball is in the air, brings the bat up into a two handed grip and swings, hitting the ball into the field. This method of hitting the ball is also used in fielding practice, and in informal (or "sand lot") games.

The main problem with the toss and hit method is that it is difficult to learn and all but the most skilled players have difficulty placing the hit ball where desired. When used as fielding practice, the practice can become ineffectual when the hitter cannot reliably hit to a precise location of fielding.

Another problem is that a new player learning to hit the ball can spend an inordinate amount of time simply learning to toss the ball into the air so he can hit the ball while bringing up and holding the bat in a position to hit the tossed ball. The skill of tossing the ball into the air and hitting the ball is not a skill used in competition.

The present invention resolves these problems by providing an improved bath with hall holder disposed on the hitting surface for holding the ball. The user may place a ball in the ball holder, adjust his hands to a proper grip, place the ball in the air by lifting and lowering the bat, and swinging the bat and hitting the ball.

It is a principal object of the present invention to provide an improved bat allowing the user to readily hit an unpitched ball.

It is another object of the present invention to provide an improved training bat.

It is another object of the present invention to provide a bat allowing the hitter to more readily place an unpitched ball into a chosen fielding area.

BRIEF DESCRIPTION OF THE DRAWINGS

The foregoing and other objects of the invention will become apparent upon reading the following specification, with reference to the appended claims and the drawings, in which:

DESCRIPTION OF THE PREFERRED EMBODIMENT

Figure 1:
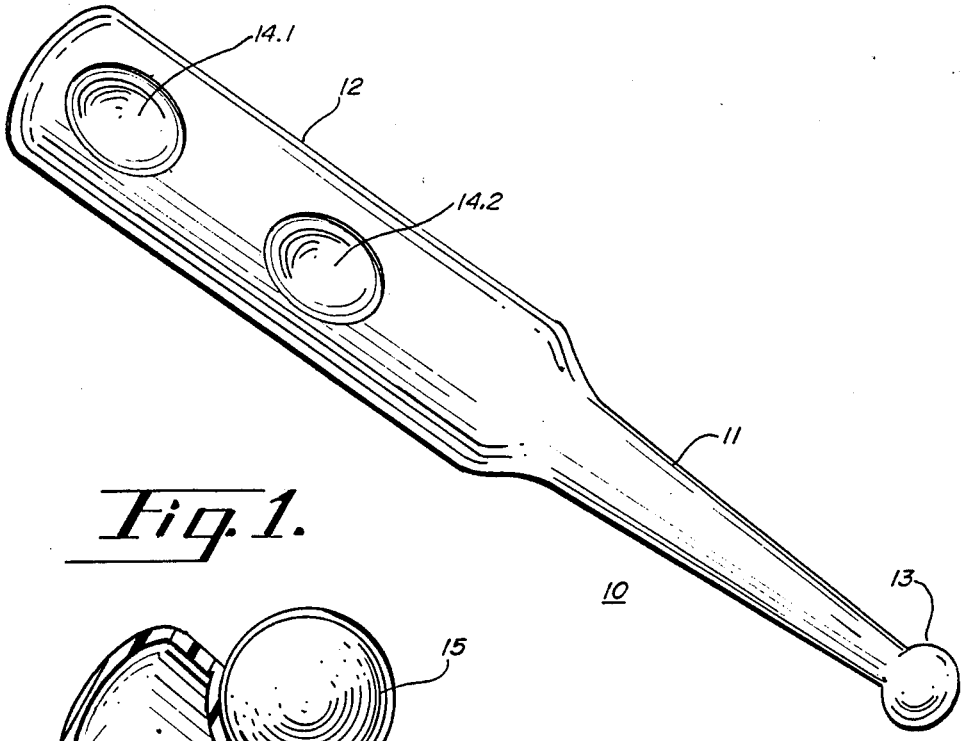
FIG. 1 is an overall perspective view of the first embodiment of the invention shown as adapted to a softball bat.
Figure 2:
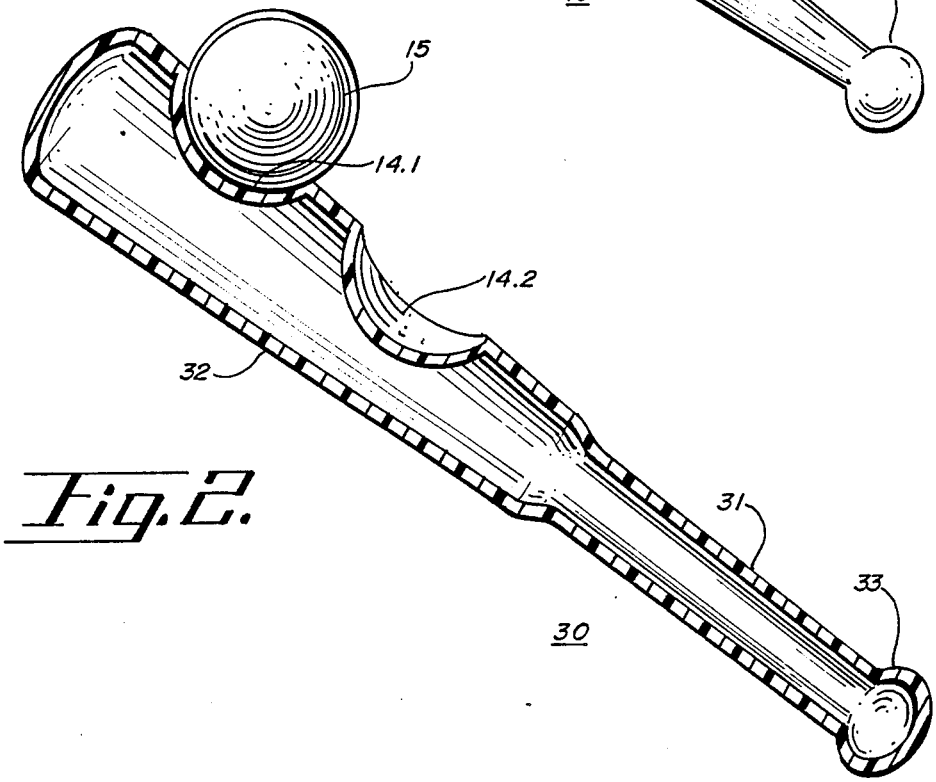
FIG. 2 is a side cutaway taken along lines 2—2 in FIG. 1 also showing a ball placed in the ball holder.

Referring first to FIG. 1, the invention comprises a bat 10 of conventional design having a handle 11 ball striking surface on the distal end 12 thereto and a safety knob 13 at the termination of the handle end. Ball holders 14.1 and 14.2 are disposed in a spaced apart relationship upon the distal end 12 of the bat 10. The bat 10, as more clearly shown in FIG. 2, is a softball bat having a cylindrical distal end 12 in compliance with the rules of softball. It is understood, however, that the shape of the distal end 12 along its length is unimportant to the invention and the invention is equally suitable for use with a baseball bat 30, as shown in FIG. 2, having a frustroconical shape to its distal end 32, in compliance with the rules of baseball.

The bat 10 may be constructed of any material and of any length and weight suitable for its intended use. In general, a bat will be constructed to be either a "regulation" bat, that is the bat will comply with the regulations and requirements of one particular sport and its sanctioning body, or the bat may be a "toy" or practice bat that does not comply with regulations of a sanctioning body. Bat 10 can be constructed of a multitude of materials including wood, aluminum, or a variety of plastics materials. Regardless of the construction of the bat, ball holder 14 is formed in the distal end 12 of the bat 10. The ball holder 14 is a formed depression extending inwardly from the surface of the distal end of the bat 10. The ball holder 14 is concave having insufficient dimensions such that a ball 15 may be placed therein and retained in the ball holder 14 while the bat is operated.

Ball holder 14 is preferably approximately circular as viewed from above and may be any curvilinear section that is usually formed as a spheric section.

The ball holder 14 may be added to an existing bat 10 or may be built into the bat at the time of its construction. When the bat 10 is constructed of wood, the ball holder 14 may be formed on the distal end 12 by removal of a sufficient quantity of wood using a suitable cutting device, such as a large centerless drill. When the bat 10 is constructed of metal such as aluminum, the ball holder 14 may typically be formed by using a high pressure punch to form the depressions of the ball holder 14 upon the distal surface 12 of the bat 10. These processes allow the adaptation of a "regulation" bat 10 to use the invention for hitting and fielding practice.

It is also common practice to use a nonregulation bat for practice purposes. Such nonregulation bats 10 are typically lightweight plastic blow molded bats particularly adapted for use by smaller children. In this application, at least one ball holder 14 is formed by integrally molding it into the bat 10 at the time of production. Such plastic bats 10 are particularly useful in teaching small children owing to their lower weight, allowing the small children to more readily swing the bat, and their increased flexibility which reduces the damage the child can cause by striking unintended objects or other persons. Additionally, a plastic bat 10 can be used with a soft foam or "nerf" ball for indoor practice since a foam ball 15 has a sufficiently low weight that it cannot be hit very far and is sufficiently soft so that it will not cause damage upon striking objects in a typical home environment.

The ball holder 14 is formed upon a bat 10. Ball holder 14 need not be disposed at any particular angle in relation to the bat. It is, however, preferred that the center of the ball holder 14 be disposed upon a radius of the bat 10 perpendicular to the longitudinal axis of the bat 10.

In its use, the user selects a suitable bat 10 and a suitable ball 15. The user graphs the bat using a batting hand grip while placing the ball 15 in the one ball holder 14 while holding the bat 10 in a substantially horizontal position. The user then quickly lifts the bat 10 in a vertical motion placing the 15 in the air. With the ball in the air, the user moves the bat backwards and swings the bat forwards striking the ball from the air. As the batter swings the bat back to strike the ball 15, he typically rotates the bat slightly, rotating the ball holders 14 away from the striking surface of the bat 10 thereby presenting the distal end 12 of the bat 10 as a hitting surface unencumbered by the ball holders 14. Upon striking the ball, the user can exercise greater control over placing the ball in a fielding location of choice.

When the user wishes to hit the ball 15 as a fly ball or great distance such as into the outfield, he would select the outermost ball holder 14.1 and place the ball therein for hitting fly balls. Similarly, when the user wish to hit the ball 15 in a line drive or as a ground ball, he would place the ball 15 in the innermost ball holder 14.2 which causes the ball to be hit in the manner selected.

Although the present invention has been described in considerable detail in the above specification, it is not intended that the invention be limited to such detail, except as may be necessitated by the appended claims.

What is claimed:

1. An elongate bat for hitting having circular cross sections and a peripheral surface, comprising (a) a handle end and a distal end, the handle end having a terminal edge and or a reduced diameter with respect to said distal end and a large diameter safety knob disposed terminally thereon opposite said distal end;

(b) the distal end having a pair of ball holders formed therein; and (c) the ball holders extending inwardly from the peripheral surface of the distal end, the first ball holder displaced a greater distance than the second ball holder from said terminal edge, the pair of ball holders further being located at the same radial position with respect to the central axis of the bat on the fact of the bat, and being spheric in shape, whereby a ball may be played by placing the ball in a ball holder raising and lowering the bat to place the ball in the air and hitting the ball with the bat.

* * * * *